United States Patent [19]

Grosjean et al.

[11] 4,348,013

[45] Sep. 7, 1982

[54] DEVICE OF REFRACTORY POROUS MATERIAL FOR BLOWING GAS INTO A BATH OF LIQUID METAL

[75] Inventors: Jean-Claude Grosjean, Semecourt; Roland Grave, Metz, both of France

[73] Assignee: Institut de Recherches de la Siderurgie Francaise, St. Germain-en-Laye, France

[21] Appl. No.: 213,548

[22] Filed: Dec. 5, 1980

[30] Foreign Application Priority Data

Dec. 10, 1979 [FR] France ..... 79 30425

[51] Int. Cl.[3] ..... C21C 5/48

[52] U.S. Cl. ..... 266/220; 266/266; 75/59

[58] Field of Search ..... 266/220, 266, 224, 270, 266/265; 75/59

[56] References Cited

U.S. PATENT DOCUMENTS

| | | | |
|---|---|---|---|
| 2,947,527 | 8/1960 | Spire | 266/220 |
| 3,610,602 | 10/1971 | Deacon et al. | 266/220 |
| 3,633,898 | 1/1972 | Josefsson et al. | 266/220 |

*Primary Examiner*—L. Dewayne Rutledge
*Assistant Examiner*—David Hey
*Attorney, Agent, or Firm*—Michael J. Striker

[57] ABSTRACT

A device for blowing gas under pressure into a bath of liquid metal comprises a mass of refractory material which is porous at least at an inner portion thereof and placed into a metallic container constituted by an outer metallic envelope closed at one of the ends thereof by a bottom member through a central portion of which a conduit extends for feeding a gas under pressure to the porous inner portion of the mass. A deflector is provided fluid-tightly connected to the bottom inwardly of the envelope in which the wall of the deflector extends parallel to that of the envelope but short of the length of the latter. This permits, on the one hand, to avoid penetration of liquid metal between the envelope and the mass of refractory material to a point where it would block the gas feeding conduit and, on the other hand, to canalize the gas through the porous portion of the mass. The present invention relates likewise to a method of making the above device.

6 Claims, 3 Drawing Figures

DEVICE OF REFRACTORY POROUS MATERIAL FOR BLOWING GAS INTO A BATH OF LIQUID METAL

BACKGROUND OF THE INVENTION

The present invention relates to a device of refractory porous material for blowing gas under pressure into a bath of liquid metal.

It is known for quite some time to manufacture from refractory material of a certain grain size (French Pat. No. 1,094,809) elements of the type which are incorporated into the refractory walls of a metallurgical receptacle containing a bath of molten material in order to blow into the bath of molten material a mixing gas and to interrupt this blowing, whenever desired, without the risk of penetration of the molten metal into the device as is the case with tuyeres.

In such devices it is, as known, absolutely necessary to prevent flow of gas into the liquid metal at the interface of the device and the refractory wall of the receptacle in which the bath of molten metal is maintained.

For this purpose it is also known to closely surround the refractory element by a metallic envelope, made for example of a sheet of steel, which is closed at one of its ends by a base plate provided with means for feeding the gas under pressure therethrough. The envelope and the base plate thus define a receptacle in which the porous mass is exposed only on one of the free faces which is destined to contact the liquid metal.

The use of such an envelope has, in addition to its function of providing lateral tightness, further advantages among which can be mentioned the possibility to constitute in connection with the base plate a casting mold for the porous mass and, on the other hand, due to its regular and smooth outer surface to permit its tight application to an opening formed in the wall of refractory material which is to receive the element, or to facilitate withdrawal of the element for its displacement after the wear of the same (French Pat. of addition No. 65,904). The envelope also serves as an armature to protect the mass of porous material against eventual shocks applied thereto during transport or handling of the element.

Besides its many advantages, the presence of a metallic envelope leads quite often to a number of disadvantages which result quite often in a rapid deterioration of the original fluid tightness at the interface of the porous mass and the envelope in such a manner that the latter is not any longer capable of carrying out the function for which it was provided.

The inventors have established from their experience that, after repeated blowing of gas through this known device provided with an outer metallic envelope, the latter suffers from permanent deformation in such a way that when no gas is blown through the device, the liquid metal will penetrate into the thus-formed space between the envelope and the porous mass.

Such metal infiltration will render the device prematurely unusable, since, on the one hand, there will form closely adjacent thereto privileged passages for the gas; the major portion thereof will thus not pass through the porous mass, and, on the other hand, the metal may penetrate deeply into the element until it blocks the means for feeding the gas incorporated into the base of the element, which of course is not without certain dangers.

SUMMARY OF THE INVENTION

It is an object of the present invention to provide a device of refractory porous material for blowing gas into a bath of liquid metal and which avoids the disadvantages of such devices known in the art.

It is a further object of the present invention to provide a device of the aforementioned kind which is composed of relatively few and simple parts so that it can be manufactured at reasonable cost, and which will stand up properly under extended use.

With these and other objects in view, which will become apparent as the description proceeds, the device of refractory porous material for blowing gas into a bath of liquid metal mainly comprises, according to the present invention, an outer metallic envelope of predetermined length having an open end and an opposite end closed by a bottom, a mass of refractory material which is porous at least in the central portion thereof substantially filling the envelope, means fluid-tightly extending through the bottom for feeding a gas under pressure towards the central porous portion of the mass so that that the gas will pass through the central portion and through the open end of the envelope, and a deflector fluid-tightly connected to the bottom inwardly of the outer envelope and having a wall parallel to that of the envelope but having a length smaller than the aforementioned predetermined length.

According to the present invention, the deflector is constituted by a simple metallic sleeve.

According to a preferred embodiment of the present invention, the mass of refractory material is composed of a central porous portion surrounded by a layer of compact refractory concrete and the deflector is positioned between the central mass and the surrounding peripheral layer.

It is further an object of the present invention to provide a method for manufacturing the above device, according to which the metallic receptacle constitutes a casting mold for the refractory material and the method according to the present invention mainly comprises the steps of forming a metallic trough open at one end from portions of a profile in form of an asymmetric U, the long branch of which, located at the outside, constitutes the aforementioned outer envelope and the small branch of which constitutes the deflector, filling this trough with compact refractory concrete in order to obtain a peripheral fluid-tight layer, reversing the thus-obtained assembly through 180° and putting the same onto a temporary support surface, filling the central cavity defined by the inner surface of the concrete layer and the support surface with a mass of porous refractory material, and finally closing the end through which the cavity has been filled by a plate fluid-tightly connected to the base of the trough and provided with means for feeding a gas under pressure against the porous refractory mass.

It will thus be understood that the present invention consists basically of relieving the outer metallic envelope of its function of providing lateral fluid tightness for the gas and to substitute for this purpose an inner deflector surrounded at a distance by the aforementioned envelope. The connection of the deflector to the base plate permits, in addition, to constitute a step against infiltration of the liquid metal which may take place between the envelope and the porous mass and to prevent, thus, the liquid metal from blocking the means for blowing gas through the device.

The deflector only partially replaces the envelope to provide fluid-tightness for the gas. The deflector presents a baffle the height of which is reduced as compared to that of the envelope. It will be understood that in the opposite case, that is if the deflector would extend from the base plate up to the free surface of the porous mass, there would be created a similar situation to that described above, with the disadvantages which the present invention aims to overcome.

However, if in accordance with a known arrangement (French Pat. No. 1,162,727) an annular layer of compact gas-impenetrable concrete is provided around the inner porous mass, the deflector according to the present invention is placed between the outer layer and the inner porous mass and the compact outer layer prolongs therefore the function of the deflector up to the free surface of the porous mass through which the gas under pressure escapes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
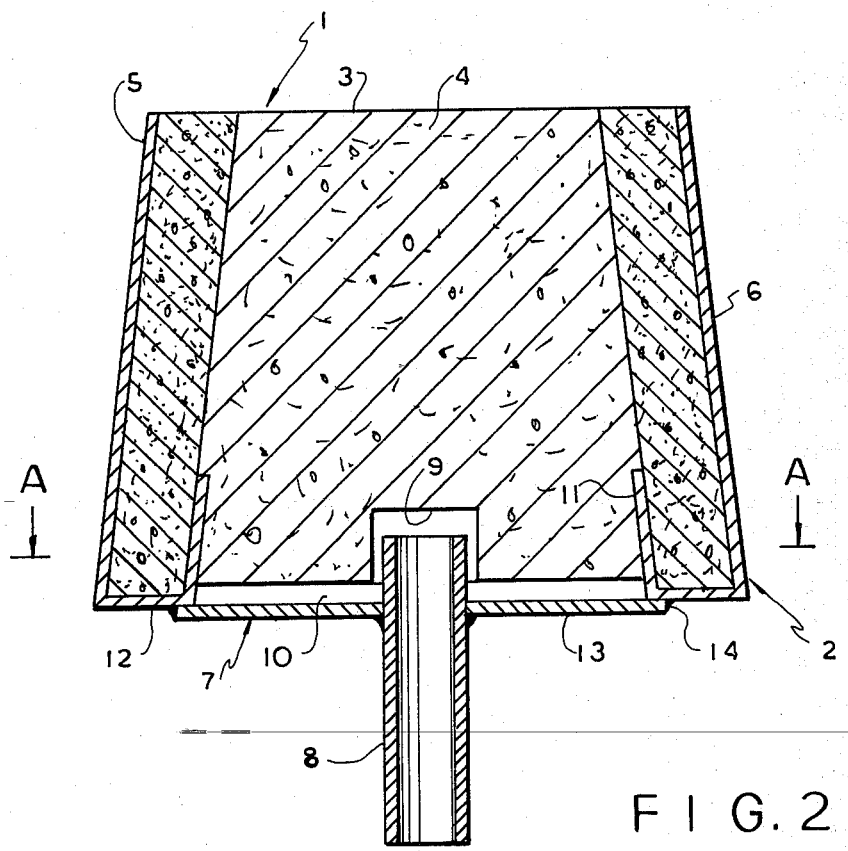
FIG. 1 is a vertical section taken along the line B—B of FIG. 2 through the device according to the present invention.
Figure 2:
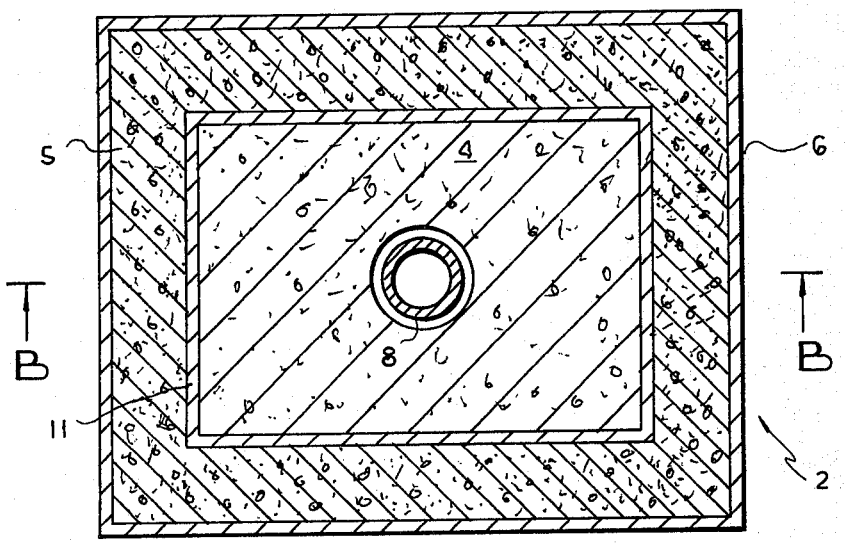
FIG. 2 is a horizontal section taken through the device along line A—A of FIG. 1.

The device according to the present invention illustrated in FIGS. 1 and 2 mainly comprises a mass of refractory material 1 located in a metallic receptacle 2 in such a manner that the mass 1 has only a free surface 3. The free surface 3 is destined to be brought into contact with liquid metal when the device is incorporated into an opening of a wall of refractory material in a metallurgical container.

The mass of refractory material 1 is constituted by an inner core 4 formed of porous refractory material permeable to gas and an outer peripheral layer 5 of a thickness of about 2 cm surrounding the core 4 and constituted by compact refractory concrete of fine grain so as to be substantially impermeable to gas.

The metallic receptacle 2, of steel sheet of a thickness of about 1.5 mm, is composed of a lateral envelope 6, the base of which is closed by a bottom 7 provided in the center thereof with a conduit 8 for the introduction of the blowing gas. The outer envelope 6 has a profile which tapers in a regular manner from the bottom 7 up to the level of the free surface 3, that is in the direction of blowing of the gas. The outer envelope 6 presents therefore an element in the form of a pyramid frustrum with a rectangular or square cross-section. It is to be mentioned that this particular shape, which is not limiting for the present invention, permits on the one hand to facilitate the insertion without play of the device in an opening of the refractory wall of a metallurgical container and, on the other hand, to assure, after the element is put there in place, that the element cannot be pushed into the liquid metal under the action of the gas under pressure blown through the conduit 8.

In order to obtain an optimal distribution of the gas in the porous mass 4, the invention provides further a blind bore 9 extending from the bottom of the porous mass 4 upwardly into the latter and forming a gas distribution chamber into which the conduit 8 extends with clearance and this distribution chamber communicates with a distribution space 10 confined between the bottom 7 and the porous mass 4 and extending over the whole surface at the base of the latter.

According to the present invention the device includes a deflector 11 inwardly spaced and surrounded by the envelope 6 and fluid-tightly connected to the bottom 7 along the whole periphery of the latter. As shown in the drawing, the deflector 11 is constituted by a metallic partition parallel to the envelope 6 but imperatively extending through a height shorter than that of the latter. The optimal height of the deflector 11 will be furnished later on.

The manner in which the device according to the present invention is manufactured will now be described. At the start, a metallic structure forming a rectangular trough is made from an asymmetrical U profile, the branches of which are parallel and slightly inclined to the vertical. The large branch is disposed exteriorly and represents the envelope 6, whereas the interiorly small branch represents the deflector 11 and the bottom connecting the two branches represents the base 12 of the profile.

Figure 3:
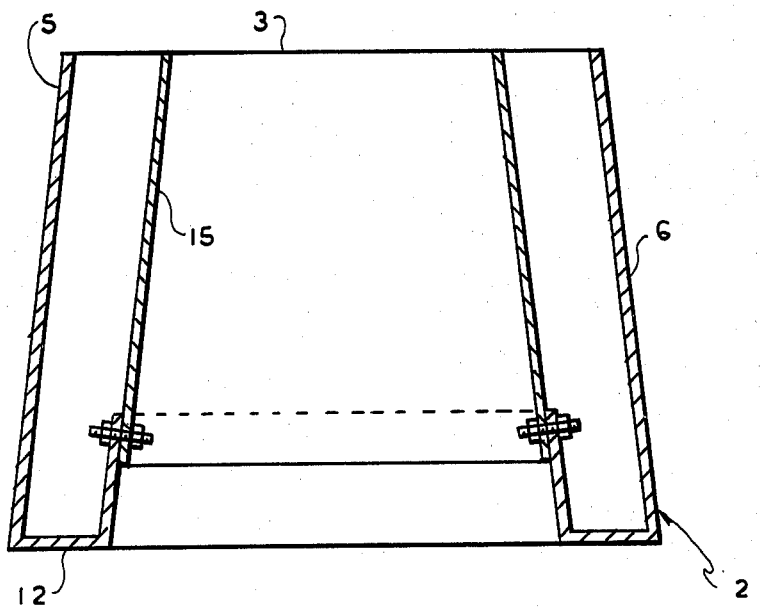
FIG. 3 illustrates an additional ring used during casting of the outer layer of the device.

The space available between the two branches is then filled up to the extremity of the large branch by a layer of refractory concrete 5 of very fine grain. This operation can be carried out without a special precaution if the concrete is of sufficient consistency. In the other case, that is if the concrete 5 has to be poured, it is necessary to provide, as shown in FIG. 3, an immovable ring 15 the outer surface of which is releasably connected in any convenient manner to the inner surface of the deflector 11 and extending parallel to the outer envelope 6 up to the free upper end of the latter. The compact concrete is then poured into the space set forth, and after the concrete has sufficiently hardened to maintain its shape, the ring 15 is disconnected from the deflector and withdrawn in downward direction.

The thus-formed assembly is reversed through 180° and subsequently placed on a support surface temporarily closing one end of the central cavity of the trough or gutter. This cavity is then filled with a porous refractory concrete 4. The filling of the cavity is stopped slightly before the level of the concrete reaches the level of the base 12 of the U, in order to preserve in the device produced the gas distribution space 10. Furthermore, a blind bore is formed extending from the large-diameter end face of the porous mass 4 into the latter, which is destined to constitute the distribution chamber 9 of the device.

After these operations are finished, a metallic plate 13 is fluid-tightly connected to the base 12 of the gutter and the plate 13 is provided at the center thereof with a conduit 8 having an end portion extending in the blind bore.

The fluid-tight connection between the plate 13 and the base 12 is realized by a weld seam 14. The thus manufactured device is then withdrawn from the support surface and after drying by baking it at low temperature is ready for use.

Any infiltration of the liquid metal between the envelope and the compact layer 5 is now not injurious any longer, since at the worst it can reach only the base of the deflector 11. The deflector forms now an obstacle against further progression of the infiltration and prevents the liquid metal from reaching the conduit 8.

In addition, the deflector 11 constitutes, with regard to the gas traversing the porous mass 4 a baffle which canalizes the gas in direction toward the free surface 3 while preventing its lateral dispersion toward the envelope 6.

It is to be mentioned that in the described embodiment the compact concrete layer 5 is by itself capable of establishing the proper canalization of the gas. Nevertheless, the invention is not limited to the specific construction illustrated, but the device could also be provided in which the whole mass of refractory material 1 is permeable to gas and in this case only the baffle 11 will assure proper canallization of the gas.

In this case, it could appear to be desirable that the deflector 11 extends through the whole height of the mass of refractory material 1, that is to a height equal to that of the outer envelope so as to canalize the gas up to the free surface 3. However, as pointed out before, this has to be rejected since the outer ends of the deflector 11 would in this case be in contact with the liquid metal contained in the metallurgical container and at such an extension of the deflector 11 all the above-described problems resulting from the infiltration of liquid metal would occur. In fact, the optimal height of the deflector 11 is substantially equal to the remaining height of the device at the moment its replacement after wear is necessary. This optimal height is on the order of about 15 cm in the event the device according to the present invention is used as a gas-permeable element in a converter for refining pig iron into steel.

It will be understood that each of the elements described above, or two or more together, may also find a useful application in other types of devices of refractory material for blowing gas into a bath of liquid metal, differing from the types described above.

While the invention has been illustrated and described as embodied in a device for blowing gas into a bath of liquid metal and including an outer metallic envelope, a mass of refractory material substantially filling the outer envelope and formed by an outer substantially gas-impermeable concrete layer surrounding a core of porous refractory material and including further a deflector at the interface of the outer layer and the core and having a height considerably smaller than that of the outer envelope, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device of refractory porous material for blowing gas into a mass of molten metal comprising an outer metallic envelope of predetermined length having an open end and an opposite end closed by a bottom; a mass of refractory material which is porous at least at a central portion thereof substantially filling said envelope, said mass of refractory material having an end face adapted to contact the mass of molten metal and being located in one plane with said open end of said metallic envelope; means fluid-tightly extending through said bottom for feeding a gas under pressure towards the central portion of said mass so that the gas will pass through said central portion of said mass and through said open end of said envelope; and a deflector fluid-tightly connected to said bottom inwardly of said outer envelope and having a wall parallel to that of said envelope but having a length shorter than that predetermined length.

2. A device as defined in claim 1, wherein said mass of refractory material comprises a central porous portion surrounded by an outer compact concrete layer impervious to gas and wherein said deflector is located between said central portion and said outer layer.

3. A device as defined in claim 2, wherein said central portion is formed with a central blind bore having an open end facing said bottom and an opposite closed end, and wherein said gas feeding means comprises a conduit having an end portion extending with clearance into said blind bore short of said closed end thereof.

4. A device as defined in claim 3, wherein said central porous portion of said mass ends short of said bottom to form between said bottom and an end of said central porous portion a gas distribution space communicating with said blind bore.

5. A device as defined in claim 1, wherein said outer envelope and said deflector taper from said bottom towards said open end of said envelope.

6. A device as defined in claim 1, wherein said envelope and said deflector have at a cross-section parallel to said bottom a rectangular configuration.

* * * * *